US005121624A

United States Patent [19]

Haughian

[11] Patent Number: 5,121,624

[45] Date of Patent: Jun. 16, 1992

[54] PIPE RING CRIMPING TOOL

[75] Inventor: Daniel J. Haughian, Mission, Canada

[73] Assignee: Haughian Sales Ltd., Mission, Canada

[21] Appl. No.: 726,706

[22] Filed: Jul. 8, 1991

[51] Int. Cl.[5] ..... B21D 7/06; B21D 41/04

[52] U.S. Cl. ..... 72/410; 81/427.5; 81/300; 16/114 R; 72/416; 29/243.517; 29/270

[58] Field of Search ..... 72/410, 409, 416; 81/427.5, 300, 405, 415, 416, 489, 421–423; 29/751, 270, 280, 243.517; 30/340; 16/114 R, DIG. 41; 285/918; 403/326, 361

[56] References Cited

U.S. PATENT DOCUMENTS

| | | | |
|---|---|---|---|
| 156,125 | 0/1874 | Blair . | |
| 601,230 | 3/1898 | Bartridge | 72/409 |
| 1,107,684 | 8/1914 | Mallory | 83/300 |
| 1,442,223 | 1/1923 | Knebusch | 403/326 |
| 1,482,888 | 2/1924 | Converse . | |
| 1,490,847 | 4/1924 | Petersen . | |
| 1,709,908 | 4/1929 | Free | 72/410 |
| 1,834,436 | 12/1931 | Straley | 81/300 |
| 2,243,086 | 5/1941 | Buettell | 81/423 |
| 2,475,208 | 7/1949 | Thureen | 81/300 |
| 2,505,859 | 5/1950 | Jockisch | 72/409 |
| 2,562,055 | 11/1950 | Miller . | |
| 2,784,995 | 3/1957 | Hawkins | 16/114 R |
| 2,819,634 | 1/1958 | Hansen . | |
| 2,941,294 | 6/1960 | Vosbikian | 30/340 |
| 3,187,545 | 6/1965 | Brewer | 81/421 |
| 3,604,565 | 9/1971 | Freeman | 403/361 |
| 4,632,050 | 12/1986 | Rupp | 403/361 |
| 4,724,729 | 2/1988 | Oetiker | 72/410 |
| 4,769,891 | 9/1988 | Corral . | |
| 4,841,597 | 6/1989 | Kolonia | 16/114 R |
| 4,921,282 | 5/1990 | Meisinger | 285/918 |

FOREIGN PATENT DOCUMENTS

| | | | |
|---|---|---|---|
| 192635 | 11/1985 | Japan | 72/410 |
| 294095 | 10/1953 | Switzerland | 81/300 |
| 877228 | 9/1961 | United Kingdom | 72/410 |
| 1188550 | 4/1970 | United Kingdom | 16/DIG. 41 |

*Primary Examiner*—Daniel C. Crane
*Attorney, Agent, or Firm*—Barrigar & Oyen

[57] ABSTRACT

This invention is directed to a novel pipe ring crimping tool which is adapted for crimping a ring over plastic plumbing pipe onto a plastic fitting. A crimping tool which comprises: (a) a first jaw component constructed to have therein a concave semi-cylindrical opening on one side, and at a first end, an elongated protrusion adapted for receiving an arm, and at the second end, part of a hinge member; (b) a second jaw component constructed to have therein a concave semi-cylindrical opening on one side, and at a first end, an elongated protrusion adapted for receiving an arm, and at the second end, part of a hinge member; (c) a connecting link member adapted to connect together in a pivotal manner the second end of the first component removed from the protrusion and the second end of the second component removed from the protrusion; (d) an elongated bar adapted to removably fit over the protrusion of the first component; and (e) a second elongated bar adapted to removably fit over the end of the protrusion of the second component.

8 Claims, 2 Drawing Sheets

PIPE RING CRIMPING TOOL

FIELD OF THE INVENTION

This invention is directed to a novel pipe ring crimping tool which is adapted for crimping a ring over plastic plumbing pipe onto a plastic fitting.

BACKGROUND OF THE INVENTION

Polybutylene plumbing pipe is becoming increasingly popular in new and existing building water pipe installations, replacing copper piping. In such plumbing systems, the fittings and the connecting pipes are constructed of polybutylene. Typically, the hollow fitting, such as an elbow, or a T-shaped fitting, is molded according to a certain size. The polybutylene pipe is then fitted over the appropriate projecting end on the fitting, and is secured firmly in place over the end of the fitting by crimping a metal ring onto the pipe where it overlaps onto the end of the fitting.

In crimping the ring onto the pipe, it is customary to use a crimping tool which resembles a common bolt cutter in that the crimping action is created by intersecting arms on a pivot with compound gears to provide leverage onto the crimping mechanism. A problem with the existing crimping tool is that the pivot fulcrum is located between the crimping end of the tool and the handles, thereby reducing leverage. Furthermore, the gears must be constantly adjusted in order to ensure that the crimping tool properly crimps the ring.

Another problem with the existing crimping tool is that since the fulcrum is between the crimping end and the user and it is therefore difficult in certain situations, such as where the piping is in the ceiling of an installation, for the installer to see the ring properly in order to ensure that the crimping end of the tool fits properly over the ring and properly crimps it onto the polybutylene pipe. In other words, the crimping tool obscures the ring from the vision of the installer.

A further problem with conventional crimping pliers is that the gears wear down and need periodic adjustment. Also, since the arms are long, it is not possible in many confined situations to apply the crimper to the crimp ring. An alternative type of crimping device such as a clamp must be used.

Several patents disclose various designs of crimping tools.

| U.S. Pat. No. | Inventor | Issue Date |
|---|---|---|
| 156,125 | Blair | October 20, 1874 |
| 1,482,888 | Converse | February 5, 1924 |
| 1,490,847 | Petersen | April 15, 1924 |
| 2,562,055 | Miller | July 24, 1951 |
| 2,819,634 | Hansen | January 14, 1958 |
| 4,769,891 | Corral | September 13, 1988 |

Hansen discloses a rope and binding and ferrule clamping tool. Hansen shows transverse semicircular concave portions 34, 34', 36 and 36', of two separate diameters. Hansen also shows two ferrule deforming members 42 and 44, of different sizes.

Blair shows a hog-ringing nipper which has the hinge "b", at one end of the tool and the handles "c" at the opposite end.

Miller discloses a hose ferrule clamping plier which has a hinge 12 at one end, and handles 9 and 10 extending from the hinge. The clamping action is unusual because the hose ferrule is crimped in wire ring 15.

Converse discloses a tool for tipping shoe laces. The crimping mechanism and the handles are on opposite sides of the pivot point.

Peterson shows a clamp fastener wherein the clamp end 8 is separated from the handles 2 and 3 by the hinge 10.

Corral illustrates a hand tool for tube fittings which shows a leverage action between the handles 14 and 16 and the head portion 28.

SUMMARY OF THE INVENTION

The invention is directed to a crimping tool which comprises: (a) a first jaw component constructed to have therein a concave semi-cylindrical opening on one side, and at a first end, an elongated protrusion adapted for receiving an arm, and at the second end, part of a hinge member; (b) a second jaw component constructed to have therein a concave semi-cylindrical opening on one side, and at a first end, an elongated protrusion adapted for receiving an arm, and at the second end, part of a hinge member; (c) a connecting link member adapted to connect together in a pivotal manner the second end of the first component removed from the protrusion and the second end of the second component removed from the protrusion; (d) an elongated bar adapted to removably fit over the protrusion of the first component; and (e) a second elongated bar adapted to removably fit over the end of the protrusion of the second component.

Both elongated bars (d) and (e) can be cylindrical in construction, and each can have in one end thereof a cylindrical opening adapted to fit over the respective first and second protrusion of the first jaw component and second jaw component.

The protrusions of the first jaw component and the second jaw component can have grooves around the circumference of the protrusions adapted to receive resilient "O" rings.

The first jaw component can be bent so that when the first elongated bar is fitted over the protrusion, the bar extends at an angle from the second jaw component. The ends of the first jaw component and the second jaw component can be rounded to prevent the respective ends from colliding with one another when the ends are pivoted about the connecting link member.

The concave semi-cylindrical opening in the first jaw component and the second jaw component can have respective aligned configurations so that when the first jaw component abuts with the second jaw component to form a cylinder. The edges of the concave semi-cylindrical openings in the first jaw component and the second jaw component can be chamferred.

The protrusions of the first jaw component and the second jaw component can have therein a respective pair of parallel grooves, the respective grooves closest to the end of the protrusions being adapted to receive an "O" ring of smaller outer diameter than the respective grooves removed from the end of the protrusions. The connecting link member can be pivotably connected to the end of the first jaw component and the end of the second jaw component removed from the respective protrusions by a pair of pins.

DRAWINGS

In drawings which illustrate specific embodiments of the invention, but which should not be construed as restricting the spirit or scope of the invention in any way:

DETAILED DESCRIPTION OF SPECIFIC EMBODIMENTS OF THE INVENTION

Figure 1:
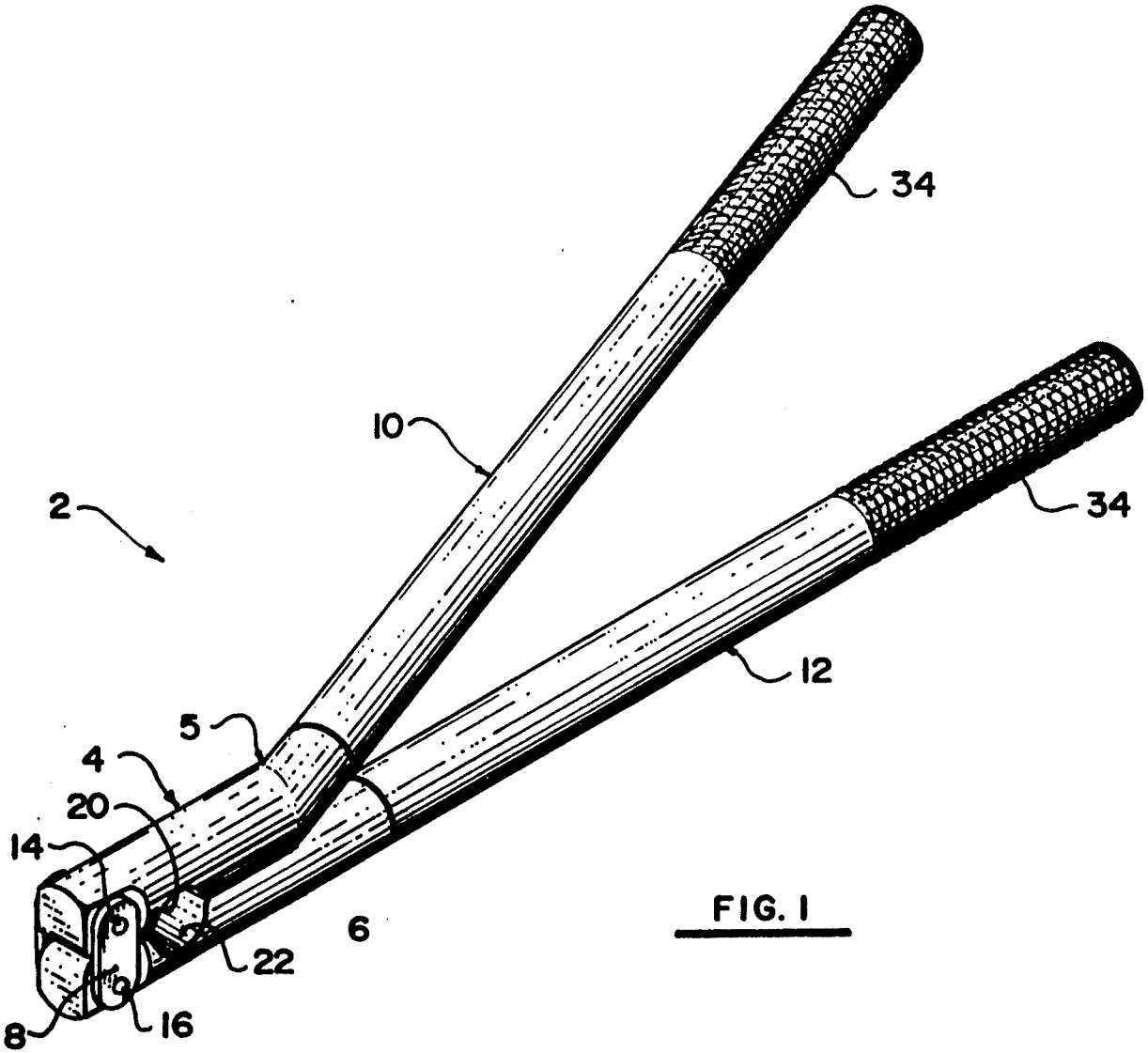
FIG. 1 illustrates an isometric view of the crimping tool.

Referring to FIG. 1, which illustrates an isometric view of the crimping tool, the crimping tool 2 is formed of five cooperating major parts, an upper jaw element 4, with a bend 5, a lower jaw element 6, a linkage assembly 8, an upper handle 10 and a lower handle 12. The upper semi-cylindrical concave opening 20 and the lower semi-cylindrical concave lower opening 22 formed in the upper jaw 4 and lower jaw 6 are sized to conform with a common copper or aluminum crimp ring which is used to crimp together polybutylene pipe in the plumbing industry.

FIG. 1 illustrates, inter ala, a bend 5 in the upper jaw element 4. This bend is about 25 degrees relative to lower jaw element 6. The bend is advantageous because it prevents the user banging his or her hands together when the handles 10 and 12 are closed under force. It is possible to gain greater leverage than with existing tools, since the tools now in use, by their design, when opened fully to receive a pipe, require the person using the tool to spread his arms so far apart, that in some instances, such as overhead, the position of the handles in relation to the position of the operator, reduces the leverage advantage. The handles of the applicant's crimp tool, when opened full to receive a pipe, maintain a much more advantageous spread, and therefore more purchase. In FIG. 1, the concave semi-cylindrical shape of the upper opening 20 and lower opening 22 are clearly illustrated. The upper jaw element 4 and lower jaw element 6 are hinged together by a pair of connecting links 8, one on each side. The link 8 is pivotally connected to upper jaw element 4 by upper pin 14, and to lower jaw element 6 by lower pin 16. The interior ends of upper jaw element 4 and lower jaw element 6 are rounded at location 36, in order to prevent upper jaw element 4 and lower jaw element 6 from jamming or colliding with one another when upper jaw element 4 and lower element 6 are moved about upper pins 14 and lower pins 16. The ends of the upper handle 10 and lower handle 12, removed from the upper jaw element 4 and lower jaw element 6 are knurled at locations 34 in order to enhance grippability of the upper handle 10 and lower handle 12.

Figure 2:
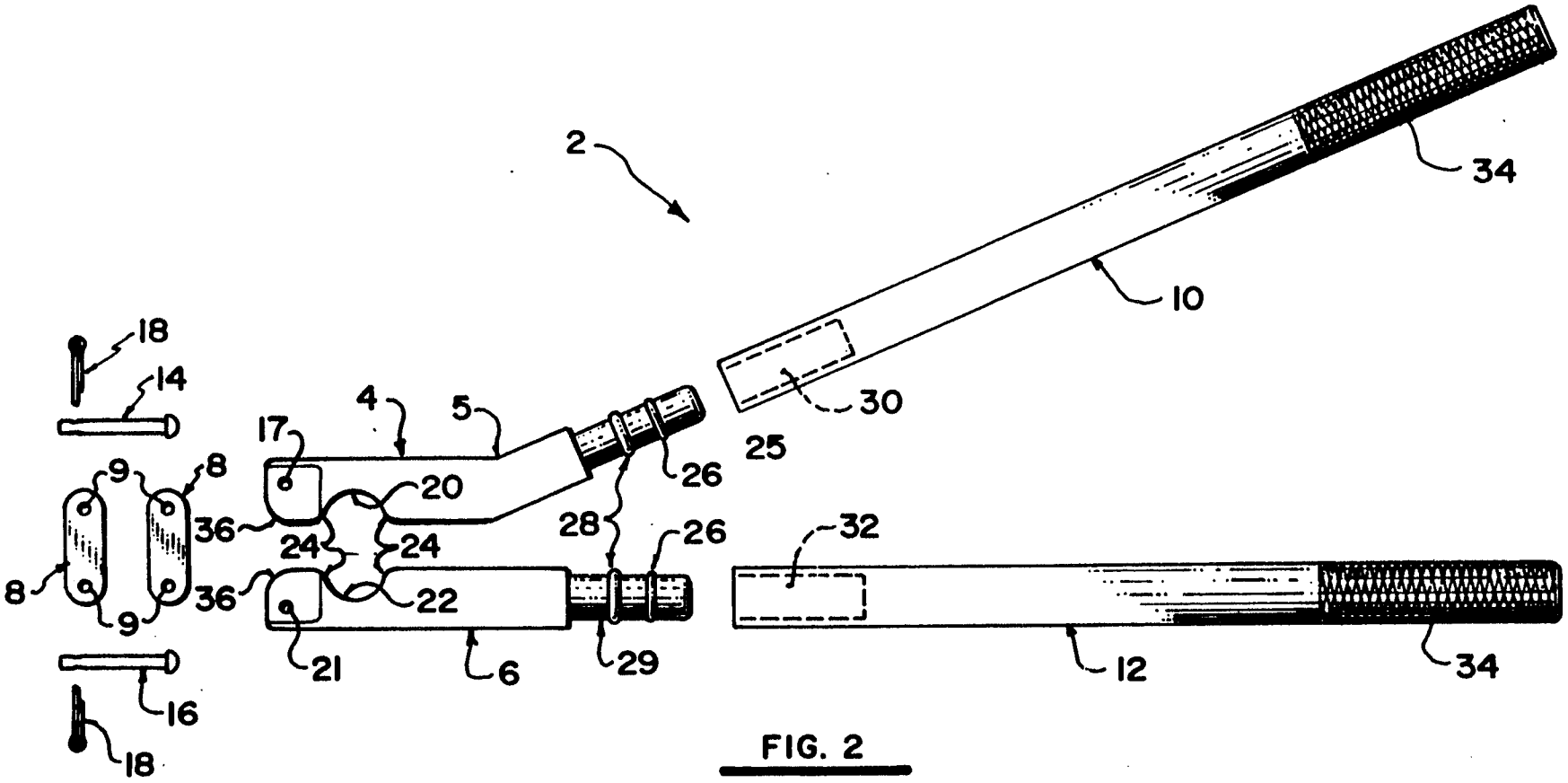
FIG. 2 illustrates an exploded side view of the crimping tool.

FIG. 2 illustrates an exploded side view of the crimping tool 2. The upper jaw element 4 has at one end thereof an upper protrusion 25. Likewise, the lower jaw element 6 has at one end thereof a lower protrusion 29. Both upper protrusion 25 and lower protrusion 29 have encircled around them a respective outer "O" ring 26 and a respective inner "O" ring 28. Outer "O" ring 26 and inner "O" ring 28 assist in enabling the upper handle 10 and lower handle 12 to be snugly and grippably secured over the respective upper protrusion 25 and lower protrusion 29. Upper handle 10 has formed in the end thereof, opposite to knurled area 34, an end opening 30. This end opening is generally cylindrical in shape and is sized so that it fits snugly over outer "O" ring 26 and inner "O" ring 28. Similarly, lower handle 12 has formed in the end thereof a cylindrical end opening 32. This opening is also sized to fit snugly over outer "O" ring 26 and inner "O" ring 28.

As seen in FIG. 2, upper jaw element 4 has formed therein an upper pin hole 17, which is adapted to receive upper pin 14, which connects connecting link 8 with upper jaw element 4. Lower jaw element 6 has also formed therein a lower pin hole 21, which is sized to receive lower pin 16, thereby enabling connecting link 8 to be hingedly connected to lower jaw element 6. The respective interior ends of upper jaw element 4 and lower jaw element 6 are rounded at location 36 in order to prevent the ends of upper jaw element 4 and lower jaw element 6 jamming when the upper jaw element 4 and lower jaw element 6 are pivoted away from one another.

FIG. 2 also illustrates the manner in which the upper semi-cylindrical concave opening 20 and the lower semi-circular opening 22 align with one another to form a cylindrical opening. The edges of the upper concave opening 20 where they join with upper jaw element 4 have chamfered edges 24. Likewise, lower concave opening 22 has chamfered edges 24 at the location where they meet the upper side of lower jaw element 6. These chamfered edges 24 are important because they enable portions of the copper ring (not shown) to flow into the chamfered areas when the copper ring is crimped in compression by forcing upper jaw element 4 and lower jaw element 6 together by exercising leverage on upper handle 10 and lower handle 12. When the copper ring is crimped over the polybutylene piping, the crimped ring has a pair of ridges on opposed sides where the chamfered edges occur.

FIG. 2 also illustrates the pair of cotter pins 18 which are used to secure upper pin 14 and lower pin 16 through the pair of connecting links 8, in order to hingedly connect upper jaw element 4 and lower jaw element 6 together pivotally by means of upper pin hole 17 and lower pin hole 21.

The crimping tool 2 has a number of important design features and advantages over existing crimping tools.

The 25 degree bend in upper jaw element 4 provides increased leverage and avoids having the user's two hands collide together when the upper handle 10 and the lower handle 12 are forced together.

The connecting links 8 are located on the side of the upper semi-cylindrical opening 20 and lower semi-cylindrical opening 22, removed from the handles 10 and 12. This facilitates the user being able to accurately place the upper opening 20 and lower opening 22 over the crimp ring because the crimp ring and the openings are visible to the user.

The hinge action is located at the end of the crimping tool 2 opposite the handles 10 and 12 which maximizes the leverage that can be exerted on the crimp ring by means of upper opening 20 and lower opening 22.

The removability feature of upper handle 10 or lower handle 12 facilitates the user being able to position the upper jaw element 4 and the lower jaw element 6 over the crimp ring. This is advantageous, particularly in overhead plumbing work, or in confined areas. Typically, the user would maintain lower handle 12 over outer "O" ring 26 and inner "O" ring 28, while removing upper handle 10. The upper jaw element 4 and lower jaw element 6 would then be positioned over the piping and the crimp ring. Then, upper handle 10 would be placed over protrusion 25, covering one or both of "O" rings 26 and 28, in order to crimp the copper ring over the polybutylene piping. Once the ring was crimped in place, then upper handle 10 would be typically removed from protrusion 25, thereby enabling the user to remove the upper jaw element 4 and lower jaw element 6, which has lower handle 12 connected thereto, from the piping and crimped copper ring.

The upper semi-cylindrical concave opening 20 and lower semi-cylindrical concave opening 22 are precisely machined so that an accurate crimp can be made on the crimp ring, thereby ensuring that equally distributed pressure is exerted around the circumference of the crimp ring. This ensures that the crimp ring exerts substantially equal compressive force on the polybutylene piping, and thereby prevents leakage through any weak area.

The four chamfered edges 24 of the two openings 20 and 22 ensure a leak-proof crimp on the crimp ring. The chamfered edges provide openings in which excess crimp ring metal can flow as a uniform pressure is exerted on the crimp ring by closing handles 10 and 12 together.

The upper handle 10 and the lower handle 12 are releasably held in place on the crimping head by a pair of "O" rings 26 and 28, on the respective upper protrusion 25 and lower protrusion 24, which are visible in FIG. 2. The inner "O" rings 28 closer to the hinge end of the crimping head are of a larger size than the outer "O" rings 26 removed from the hinge end of the crimping head. This facilitates placing the upper and lower handles 10 and 12 over the ends of the upper protrusion 25 and lower protrusion 29 of the crimping head. In temporary use situations, the handle need only be placed over the smaller outer "O" ring, in order to operate the crimping head (upper jaw element 4 and lower jaw element 6).

Although not shown in the drawings, a spring can be positioned underneath the linkage. This spring is designed to ensure that the linkage assembly is properly aligned. A stop (not shown) can also be constructed under the linkage assembly so that the crimping head cannot be opened beyond a certain point. In that way, the spring is prevented from popping out if the crimping head is opened too far.

As will be apparent to those skilled in the art in the light of the foregoing disclosure, many alterations and modifications are possible in the practice of this invention without departing from the spirit or scope thereof. Accordingly, the scope of the invention is to be construed in accordance with the substance defined by the following claims.

What is claimed is:

1. A crimping tool which comprises:

(a) a first jaw component constructed to have one side thereof a concave semi-cylindrical opening with champferred edges, and at a first end thereof, an elongated cylindrical protrusion adapted for detachably receiving a bar, the protrusion having spaced apart first and second grooves around the circumference thereof, the cylindrical shape of the protrusion extending entirely from the first groove to the second groove, the first and second grooves having respective first and second resilient O-rings thereon, the circumference of the first O-ring which is proximate to the end of the protrusion having a smaller circumference than the circumference of the second O-ring, and at the second end thereof, part of a hinge member;

(b) a second jaw component constructed to have one side thereof a concave semi-cylindrical opening with champferred edge, and at a first end thereof, an elongated cylindrical protrusion adapted for detachably receiving a bar, the protrusion having spaced apart third and fourth grooves around the circumference thereof, the cylindrical shape of the protrusion extending entirely from the third groove to the fourth groove, the third and fourth grooves having respective third and fourth resilient O-rings thereon, the circumference of the third O-ring which is proximate to the end of the protrusion having a smaller circumference than the circumference of the fourth O-ring and at the second end thereof, part of a hinge member;

(c) a connecting link member connecting together the first and second jaw components in a pivotal manner, the second end of the first jaw component removed from the protrusion and the second end of the second jaw component removed from the protrusion;

(d) an elongated cylindrical bar having at one end thereof a cylindrical opening removably fitted over the end of the cylindrical protrusion and the first and second O-rings of the first jaw component; and (e) a second elongated cylindrical bar having at one end thereof a cylindrical opening removably fitted over the end of the cylindrical protrusion and the third and fourth O-rings of the second jaw component the connecting link member being located on the first and second jaw components at a position so that the openings are situated between the connecting link member and the bars.

2. A crimping tool as claimed in claim 1 wherein the first jaw component is bent so that when the first elongated bar is fitted over the protrusion, the bar extends at an angle from the second jaw component.

3. A crimping tool as claimed in claim 2 wherein the respective second ends of the first jaw component and the second jaw component are rounded to prevent the respective ends from colliding with one another when the ends are pivoted about the connecting link member.

4. A crimping tool as claimed in claim 1 wherein the concave semi-cylindrical opening in the first jaw component and the second jaw component have respective aligned configurations so that they form a hollow cylinder when the first jaw component abuts with the second jaw component.

5. A crimping tool as claimed in 1 wherein the first and second grooves on the protrusion of the first jaw component and the first and second grooves on the protrusion of the second jaw component are respectively parallel to one another, the first groove closest to the end of the respective protrusion being deeper than the second groove removed from the end of the respective protrusion.

6. A crimping tool as claimed in claim 1 wherein the connecting link member is pivotably connected to the second end of the first jaw component and to the second end of the second jaw component removed from the respective protrusions by a pair of pins.

7. A crimping tool as claimed in claim 1 wherein the first "O" ring and the third "O" ring are of larger diameter than the respective second and fourth "O" rings.

8. A crimping tool which comprises:

(a) a first jaw component constructed to have therein on one side a concave semi-cylindrical opening, the edges of the opening where they meet the main body of the first jaw component being champferred, and at a first end, an elongated cylindrical protrusion adapted for receiving a bar, and at a second end, a hole for receiving a pin member, the elongated cylindrical protrusion having formed therein first and second spaced apart parallel circular grooves around the circumference of the protrusion, the cylindrical shape of the protrusion extending entirely from the first groove to the second groove of the first jaw component, the first groove having thereon therein a first larger outer diameter resilient "O" ring and the second groove having a second smaller outer diameter resilient "O" ring, the smaller outer diameter resilient "O" ring being located proximate to the end of the elongated protrusion, and the first jaw component being bent at an angle at a point between the opening and the first end;

(b) a second jaw component constructed to have therein on one side a concave semi-cylindrical opening, the edges of the opening where they meet the main body of the second jaw component being champferred, and at a first end an elongated cylindrical protrusion adapted for receiving a bar, and at a second end, a hole for receiving a pin member, the elongated cylindrical protrusion having formed therein first and second spaced apart parallel circular grooves around the circumference of the protrusion, the cylindrical shape of the protrusion extending entirely from the first groove to the second groove of the second jaw component, the first groove having thereon a first larger outer diameter resilient "O" ring and the the second groove having thereon a second smaller outer diameter resilient "O" ring, the smaller outer diameter resilient "O" ring being located proximate to the end of the elongated protrusion;

(c) a connecting link member with a pair of holes therein, the link member connecting siad first and second jaw components in a pivotal manner by first and second pins to the second end of the first jaw component removed from the protrusion, by means of the hole in the first jaw component, and to the second end of the second jaw component removed from the protrusion, by means of the hole in the second end of the second jaw component removed from the protrusion;

(d) an elongated cylindrical bar with a cylindrical opening in one end thereof removably fitted over one or both of the first and second "O" rings and the protrusion of the first jaw component; and (e) a second cylindrical elongated bar with a cylindrical opening in one end thereof removably fitted over one or both of the first and second "O" rings in the protrusion of the second jaw component the connecting link member being located on the first and second jaw components at a position so that the openings are situated between the connecting link member and the bars.

* * * * *